United States Patent [19]

Buchanan

[11] 4,243,061

[45] Jan. 6, 1981

[54] HAIR CURLING AND WAVING DEVICE

[76] Inventor: Glen W. Buchanan, 7049 Charing Ct., Dayton, Ohio 45424

[21] Appl. No.: 14,728

[22] Filed: Feb. 23, 1979

[51] Int. Cl.[3] ..... A45D 2/24

[52] U.S. Cl. ..... 132/37 R; 219/255

[58] Field of Search ..... 132/37 R, 32 R, 31 R, 132/33 C, 36 D, 36.1 R, 129; 219/255

[56] References Cited

U.S. PATENT DOCUMENTS

| | | | |
|---|---|---|---|
| 1,676,405 | 7/1928 | Robadey-Margot | 132/32 R X |
| 1,694,672 | 12/1928 | Rogler | 132/32 A |
| 2,254,266 | 9/1941 | Cannon | 132/37 R |
| 2,490,124 | 12/1949 | Gregory | 132/31 R |
| 3,981,314 | 9/1976 | Barradas | 132/9 |
| 4,032,747 | 6/1977 | Kunz | 219/225 |
| 4,151,850 | 5/1979 | Nathe | 132/37 R |

*Primary Examiner*—G. E. McNeill

*Attorney, Agent, or Firm*—Biebel, French & Nauman

[57] ABSTRACT

A hair curling and waving device is provided having a plurality of elongated waving members disposed in two groups with the groups being secured at one end to a handle and relatively rotatable as groups into and out of intermeshing engagement, with several of the members being provided with heating and/or steaming means for permanently setting hair wrapped about the members. A plurality of comb-like wave guides are also secured to the handle and extend parallel to the waving members and adjacent thereto for engaging the hair as it is wrapped around adjacent waving members. Some of the wave guides are preferably movable longitudinally so as to move portions of the hair which are engaged with the comb-like teeth of the wave guides in order to produce a further wavy appearance in the hair. The groups of intermeshing waving members are relatively rotatable so that the hair can be inserted between the two groups of members and then closed upon the hair in order to cause the hair to take an arcuate path in alternate directions about adjacent waving members when the two groups are rotated into intermeshing engagement. The groups of members can be inter-connected to permit their disassembly so that at least one of the waving members can be operated independently for curling hair in a conventional manner. Also, the handle portion can be provided with auxilliary connecting means for securing a hair drying blower to the at least one separately operable waving member in order to dry the hair at the same time that it is being curled.

13 Claims, 12 Drawing Figures

HAIR CURLING AND WAVING DEVICE

BACKGROUND OF THE INVENTION

1. Field of the Invention

The present invention relates to hair treating devices, and more particularly, to devices for permanently curling and waving the hair through mechanical means.

2. Prior Art

Hair curling devices and hair waving devices have been separately known for a long time and have taken many different forms. The most basic form of hair curling devices which has been in existence for some time is a single cylindrical member having a handle portion and generally is provided with an electrical heating element in the cylindrical portion which can be hand held with the hair to be curled wrapped around the cylindrical portion and then held in this position until the heat has caused a permanent curling of the hair. In addition, some such devices have incorporated steaming features which cause vaporization of water that is expelled through a plurality of holes along the length of the cylinder so as to pass through the hair and assist in establishing a permanent curl through the use of hot moist vapor and thus reduce damage to the hair that might otherwise occur simply by application of heat alone. Such devices also often provide a spring loaded rotatable clamp which engages the hair after it has been wrapped around the cylindrical portion and assist in holding the hair in position during the time necessary for permanently curling it.

Similar devices have been developed for placing waves in the hair. Since a plurality of waves are generally considered fashionable, it is common for such devices to have a plurality of cylindrical elements for placing a plurality of waves in a section of hair rather than using a single cylinder as in the case of a curling device. Otherwise, the devices generally incorporate the same features as the curling devices discussed above, such as some means for applying heat to the hair to establish the permanent wave and often also incorporate steaming devices, again to reduce possible damage to the hair during the setting period. Examples of the various types of devices utilized in the past for waving hair are illustrated by the following U.S. Pat. Nos. Bradley 911,571; Cefalu et al 1,896,940; Farrell 2,006,946; and Keele 2,048,934. It is to be noted that none of the devices are designed to be used as either a curling or waving device, but merely have the single function of placing waves in the hair although by various mechanical means.

SUMMARY OF THE INVENTION

The present invention provides a hair curling and waving device which, in addition to providing both hair curling and waving equipment in a single device in some embodiments, is more easily operable than prior art devices. This is accomplished by providing a hair waving device which has first and second elongated groups of hair waving members extending from a handle and mounted thereon for intermeshing engagement with the first group of waving members being rotatable relative to the second group about end portions of both groups adjacent the handle and which rotation is between a position in which the members of the first and second groups are disposed in a non-intermeshed position sufficiently separated for inserting a plurality of strands of hair, and a position wherein the first and second groups are disposed in an intermeshed position wherein the strands of hair are alternately curved together in opposite directions about adjacent ones of the hair waving members. In addition, the first and second groups may be so interconnected as to be separated with one of the waving members being further separated from all the rest so that it may be utilized independently of all of the other members for the purpose of curling hair thereabout and thus provides the double features referred to above.

Further, a plurality of elongated comb-like members are also provided and are mounted to the handle and rotatable with one of the groups of waving members relative to the other group so that when the two groups of waving members are rotated into the intermeshed position the teeth of the comb-like members will engage the hair. It is further preferable that at least one of the comb-like members is movable longitudinally so that the portion of the hair which it engages can be moved laterally relative to the remaining hair and thus provide a further desirable waving effect in the hair.

It is also preferable that several of the waving members be provided with heating and/or steaming elements along a substantial portion of their length which will be in contact with the hair so as to assist in the permanent setting of the hair by the application of heat and/or steam. The electrical elements utilized to provide the heat and/or steam are removably interconnected through the handle portion which is provided with a cord that can be inserted in a conventional electrical outlet in the home. In addition, as a further alternative, it is contemplated that the handle portion which remains connected to the one removable waving member for independent use is provided with a further connector which can be coupled to a blower so that during the independent curling operation the hair may be blown dry with the blower.

DETAILED DESCRIPTION OF THE PREFERRED EMBODIMENTS

Figures 1, 2, 7:
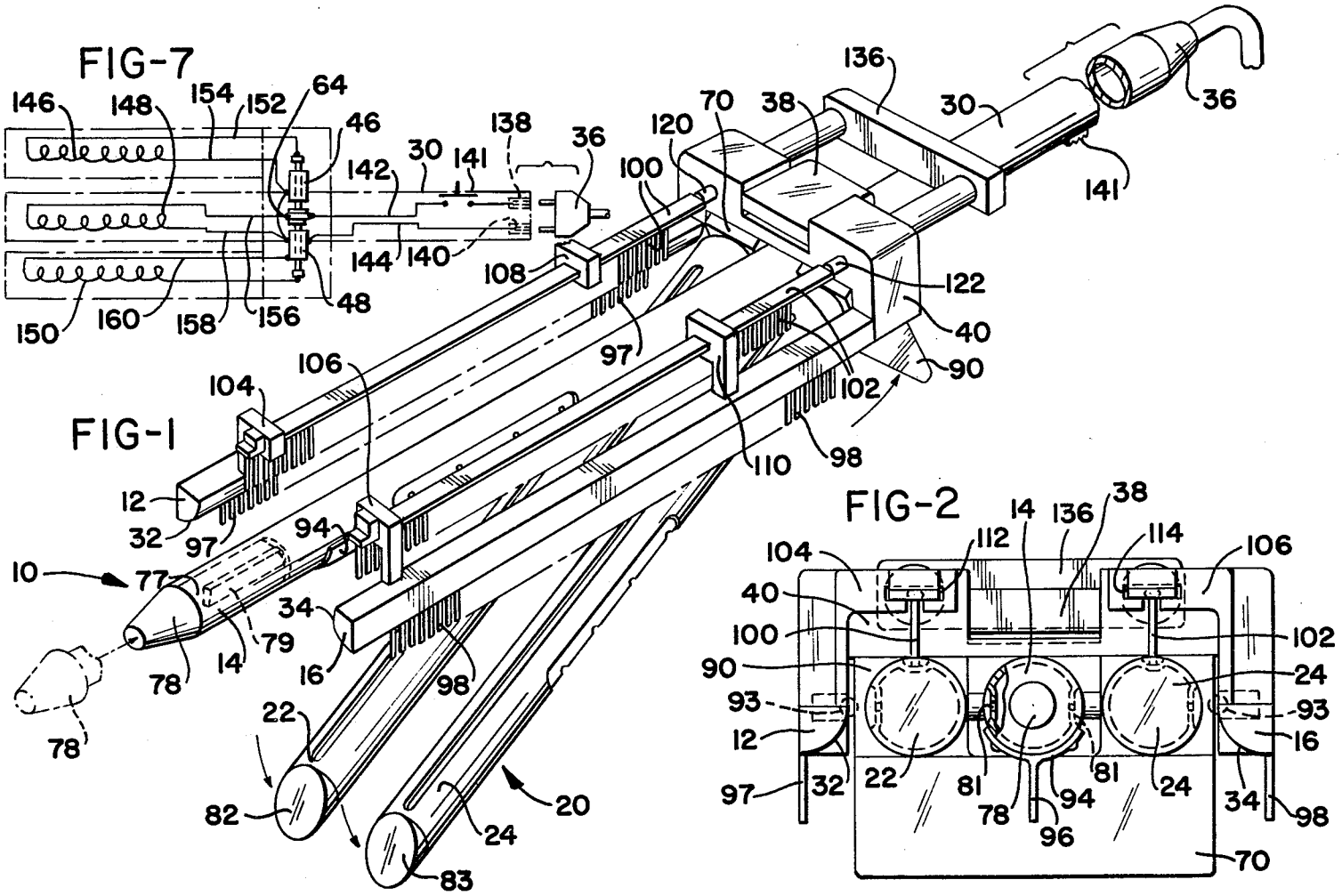
FIG. 1 is a pictorial illustration of the preferred embodiment of the present invention with the elongated waving members shown in their non-intermeshed position.
FIG. 2 is an end view of the embodiment of FIG. 1 looking towards the handle from the distal end of the waving members and positioned with the waving members in the intermeshed position.
FIG. 7 is a schematic wiring diagram for the heating elements disposed in the elongated waving members of the preferred embodiment.

Referring first to the preferred embodiment as illustrated in FIG. 1, it is composed of three major components which can be generally designated as a first group of elongated waving members 10, which in the preferred embodiment, as illustrated in FIG. 1 is composed of three such members 12, 14 and 16; a second group of elongated waving members 20 composed of two such members 22 and 24, and a handle portion 30 to which the first and second groups of waving members 10 and 20 are attached.

Waving members 12 and 16 have arcuate external surfaces 32 and 34 on their inside portions such as would be formed by a cylindrical quadrant, which will come in contact with the hair and form waves therein. Thus, it is unnecessary to have these outermost waving members 12 and 16 completely cylindrical, since only the arcuate portions 32 and 34 will actually come into contact with hair. On the other hand, the central elongated waving member 14 is completely cylindrical since the hair will be wrapped around at least the upper half of the external surface area of this member during waving. The outer waving members 12 and 16 may either be hollow or solid, but the center cylindrical waving member 14 is preferably a hollow cylindrical tube in which can be inserted a heating device of the general type disclosed in detail below.

Both of the elongated waving members 22 and 24 of the second group of members 20 are preferably cylindrical hollow tubes in which heating devices may also be inserted, as with waving member 14. Obviously, all of the waving members described above may have alternate cross sectional configurations although it is preferable that at least the portions thereof which will contact the hair during the waving operation are arcuate so as to present a smooth wave form in the hair.

Figures 5, 6:
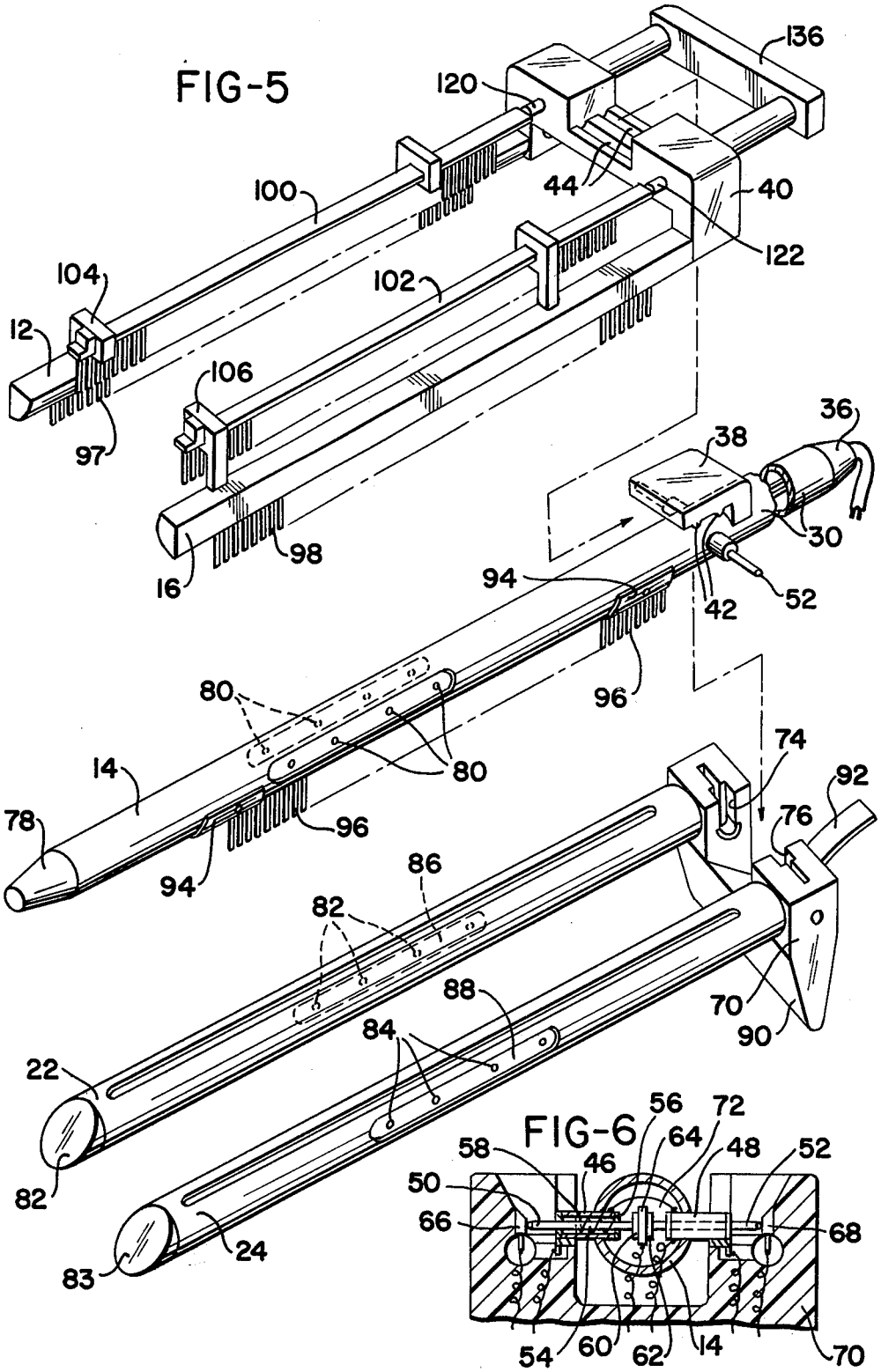
FIG. 5 is a pictorial exploded view illustrating the embodiment of FIG. 1.
FIG. 6 is a cross sectional view through line 6—6 of FIG. 4.

Referring again to the central waving member 14 of the first group of members 10, it is preferably formed integral with the handle portion 30 as best illustrated in FIG. 5. In fact, a single cylindrical tube can be utilized to form both the handle portion 30 and the waving member 14. A removable connector member 36 is removably mounted in the rear portion of the handle portion 30 for providing electricity to the heating elements as described in detail in connection with FIG. 7 below. Secured inboard of the handle portion 30 to the cylindrical waving member 14 is an L-shaped bracket 38 which is designed to be slightly flexible in order to permit interengagement with a support member 40 which supports the outer waving members 12 and 16 as described in detail below. On the inner surface of L-shaped bracket 38 are a pair of ridges 42 of semi-circular cross section, which extend across the inner surface of L-shaped bracket 38 and matingly engage corresponding semi-cylindrical recesses 44 in support bracket 40.

Secured to opposite sides of the cylinder forming waving member 14 with their center line in a plan parallel to the plane containing the leg portion of L-shaped support bracket 38 are a pair of cylindrical connector housings 46 and 48 which are made of electrically conductive material and are insulated from waving member 14, or if waving member 14 is constructed of an insulating material itself, that is sufficient. In any event, the cylindrical connector housings 46 and 48 are designed to provide contact for electrical supply to the heating elements described below.

Extending through the center of cylindrical connector housings 46 and 48 and insulated therefrom are electrical connector pins 50 and 52. Both electrical connector pins 50 and 52 are spring biased outwardly by a spring such as 54 shown in the cross sectional view of connector housing 46 in FIG. 6. Spring 54 is captive between an end cap 56 and a washer-like member 58 secured to the central region of pin 50. The internal parts and connections of connector housing 46 and connector pin 52 are identical to those of housing 46 although not shown in the cross section of FIG. 6. The innermost ends of connector pins 50 and 52 have head portions 60 and 62 which engage a central electrical supply lead in the form of a bar 64 mounted in the central portion of the handle portion 30. The outermost ends of connector pins 50 and 52 are rounded to engage respective contacts 66 and 68 embedded in a combined actuating lever and support member 70 made of insulative material such as plastic, and to which are secured for rotation therewith the second group of elongated waving members 20 consisting of members 22 and 24.

Referring again to the cross sectional view of FIG. 6, a jumper lead 72 interconnects conductive portions of connector housings 46 and 48. To each of the various connectors and conductive members are operably secured leads which extend to each of the heating elements as discussed below in connection with FIG. 7. The combined lever and support member 70 is provided with vertical slots 74 and 76 which are proportioned to receive connector housings 46 and 48 and connector pins 50 and 52 so as to produce electrical interconnection from the handle to the various waving members on the assembly. As can be seen from FIG. 6, the outermost end wall of each of the vertical slots 74 and 76 is angled to force inward movement of the pins by compression of springs 54 so that the outer end portion of the pins engage connectors 66 and 68 at the same time that the head portions 60 and 62 contact the center bar 64.

As previously mentioned, each of the waving members 14, 22, and 24 is preferably provided with a heating and/or steaming device to cause heat and/or steam to be applied to the hair in order to effect the permanent setting thereof to produce waves in the hair. As an example of one means of accomplishing this, the preferred embodiment is provided with a water reservoir 77 defined in the distal cylindrical end portion of waving member 14 and which is provided with a closure cap 78. The bottom of the reservoir 77 is provided with an opening in communication with the remaining cylindrical interior of the waving member 14 and has inserted in the opening a wick 79 which absorbs water from reservoir 77 and presents its lower surface to the heating element described below, so that water which is absorbed by the wick 79 will be vaporized at its lower end in the main body of cylindrical waving member 14.

A plurality of steam openings 80 are provided in the recessed areas 81 on opposite sides of waving member 14 to introduce the steam to the hair which is woven about the member 14. The heating element is designed such that if steam setting is not desired the water may need not be introduced to reservoir 77 and the hair will be permanently set by the heat generated by the heating element alone.

Cylindrical waving members 22 and 24 are constructed essentially the same as waving member 14 described above, with the exception that the outer end caps 82 and 83 have an angled surface rather than the conical surface of the end cap 78 of waving member 14. Otherwise, the waving members 22 and 24 are provided with similar wicks and steaming devices, including the heating coils as utilized in waving member 14. Likewise, a plurality of steam openings 82 are provided in recessed areas 86 and 88 located on opposed outer sides of waving members 22 and 24 where they will come into contact with hair woven around and through the members as described below in connection with FIGS. 8–10.

The end caps 82 and 83 are of course slanted in order to assist in insertion of the hair between the two groups of waving members 10 and 20. This configuration, however, is not essential and could be conical or other desirable shape as also can be the end cap 78 of waving member 14.

Figure 4:
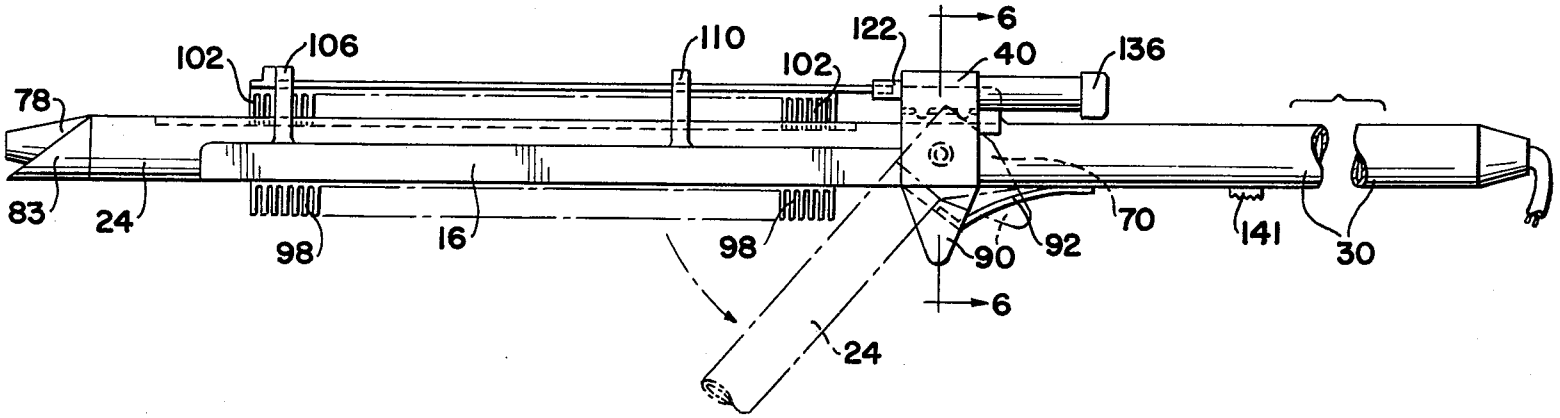
FIG. 4 is a side view of the embodiment of FIG. 1 with the position of the waving members in the nonintermeshed position being shown in phantom.

The opposite ends of waving members 22 and 24 from the capped ends are fixedly secured to the upper outer face of combined lever and support member 70 and could, if desired, be formed in one piece therewith. The lower tapered portion 90 of combined lever and support member 70 is used to apply pressure with the hand thereto to rotate the second group of waving member 20 into and out of their intermeshing position with the first group of waving members 10. A leaf spring 92 is connected to the back upper surface of combined lever and support member 70 and is engaged with the lower surface of handle portion 30, as best seen in FIG. 4, to bias the second group of waving members 20 into the intermeshed position as shown in FIG. 4, which bias is overcome by application of finger pressure to rotate the second group into the non-intermeshed position shown in phantom in FIG. 4 to permit insertion of the hair in the V-shaped opening between the two groups.

Referring again to FIG. 5, the outer waving members 12 and 16 of the first group 10 are secured at their rear end portions to support member 40 and could be formed integral therewith if desired. As mentioned previously, support member 40 is provided with recesses 44 which interconnect with the L-shaped bracket 38 to hold the two pieces together. In addition, as best seen in FIG. 2, a pair of ball-detents 93 are housed in the inner surface portions of support member 40 and engage corresponding recesses in the outer surfaces of lever 70 so that when support bracket 40 is inserted under L-shaped bracket 38 the detents likewise snap into position in the lever 70 to assist in holding the assembly together.

As is best seen in FIGS. 1, 2 and 5, there is associated with each of the waving members a comb-like wave guide member such as member 94 which is secured to the lower surface of waving member 14 and extends for substantially the entire length thereof. It is provided with a plurality of teeth 96 which are intended to engage and pass through hair positioned in the device in order to hold it in position during the setting operation. Likewise, there are comb-like wave guide members 97 and 98, respectively secured to the outer edge portions of waving members 12 and 16, which also act as wave guides to hold the hair in position.

A further pair of comb-like wave guide members 100 and 102 are disposed above each of the waving members 22 and 24, respectively, and are mounted for longitudinal movement relative thereto by front support brackets 104 and 106 and rear support brackets 108 and 110, respectively. Support brackets 104–110 are mounted to the upper surface of waving members 12 and 16 so that wave guides 100 and 102 are supported for relative movement therewith into and out of proximity with the waving members 22 and 24. Thus, hair can be inserted in the device when in the open position and the teeth on wave guides 100 and 102 will engage the hair upon closing the device into the intermeshed position as shown in FIG. 2. Wave guides 100 and 102 are slidingly supported in slot like openings 112 and 114 in each of the brackets 104–110.

Figure 3:
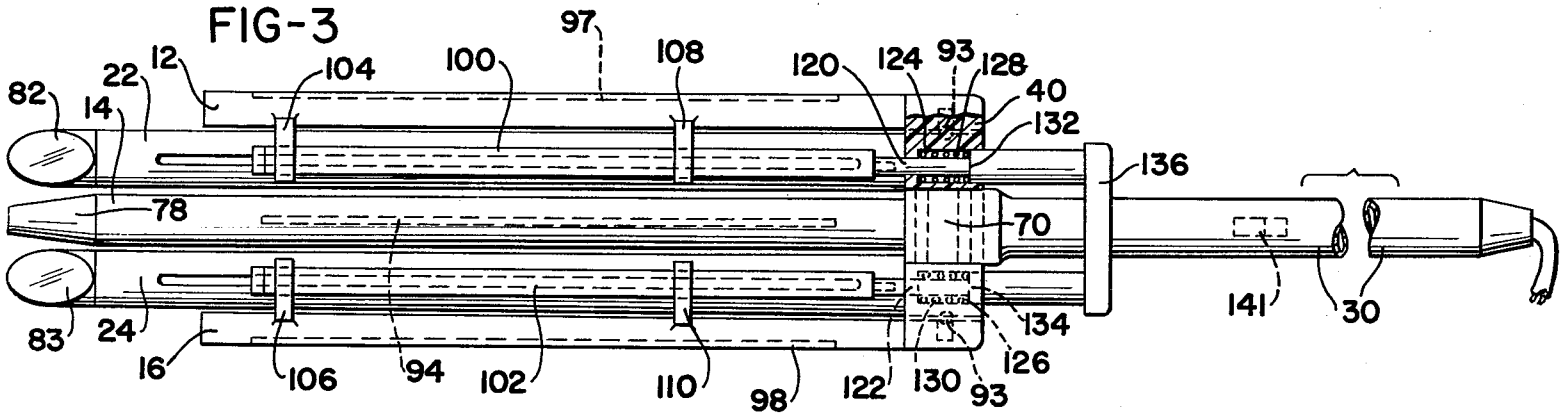
FIG. 3 is a top plan view of the embodiment of FIG. 1.

The rear end portions of the upper main bodies of wave guides 100 and 102 are interconnected to cylindrical rods 120 and 122 for movement therewith longitudinally of the waving members. As best seen in the partial cross sectional view of FIG. 3, the plungers 120 and 122 extend through corresponding cylindrical openings 124 and 126 formed in support member 40 and are biased in the rearward direction towards handle portion 30 by springs 128 and 130 which act against the shelves 132 and 134 formed by the larger diameter cylindrical portion of plungers 120 and 122. Plungers 120 and 122 are secured together at their outer ends by a cross bar 136 so that the two comb-like wave guide members 100 and 102 will be moved together.

Referring now to the electrical schematic diagram of FIG. 7, the general outline of the device is illustrated in phantom as a top plan view of the device showing the layout in solid lines of the circuitry. The removable connector 36 is provided with a pair of male connectors which immediately engage the female connectors 138 and 140 in the handle portion 30 of the device and are in turn connected to on-off switch 141. Leads 142 and 144 extend through the handle portion to the connector bar 64 and cylindrical housing 48, respectively, to which they are connected such as by soldering or the like.

Three heating coils 146, 148, and 150 are mounted inside the cylindrical waving members 22, 14 and 24, respectively. Heating coils 146 through 150 are designed to provide sufficient heat to set the hair and/or vaporize liquid which has been placed in the waving members as described above, in order to provide the steam for setting the hair. One lead wire 152 is connected to one side of the heating coil 146 and to the connector 68. The other lead wire 154 is connected to the opposite end of the heating coil 146 and to the housing 46. A lead wire 156 is connected to one end of heating coil 148 and to central connector bar 64. Another lead wire 158 is connected to the opposite end of the heating coil 148 and to the surface of cylindrical housing 48. Heating coil 150 is attached to a lead line 160 which has an opposite end attached to the surface of cylindrical housing 48. A further lead line is secured at the opposite end of heating coil 150 and to contact 68. Thus, when the device is assembled, current will flow through all of the heating coils when switch 141 is closed.

Figure 8:
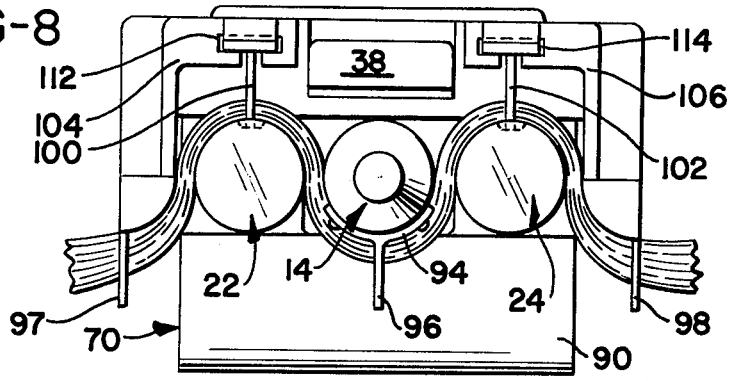
FIG. 8 is an end view of the embodiment of FIG. 1 illustrating the position of the hair about the waving members when they are disposed in their intermeshed positions.

In operation, the second group of waving members 20 is rotated to the position illustrated in FIG. 1, relative to the first group of waving members 10 by means of the operator pulling upon the lever 70. A plurality of strands of hair is then inserted in the V-shaped opening between the two groups of waving members 10 and 20, resting across the second group of waving members. The operator then releases pressure on the lever 70 and the biasing spring 92 causes the second group of members to rotate into intermeshed position with the first group of waving members 10 so that the hair will become wrapped about the waving members as illustrated in FIG. 8.

Figure 9:
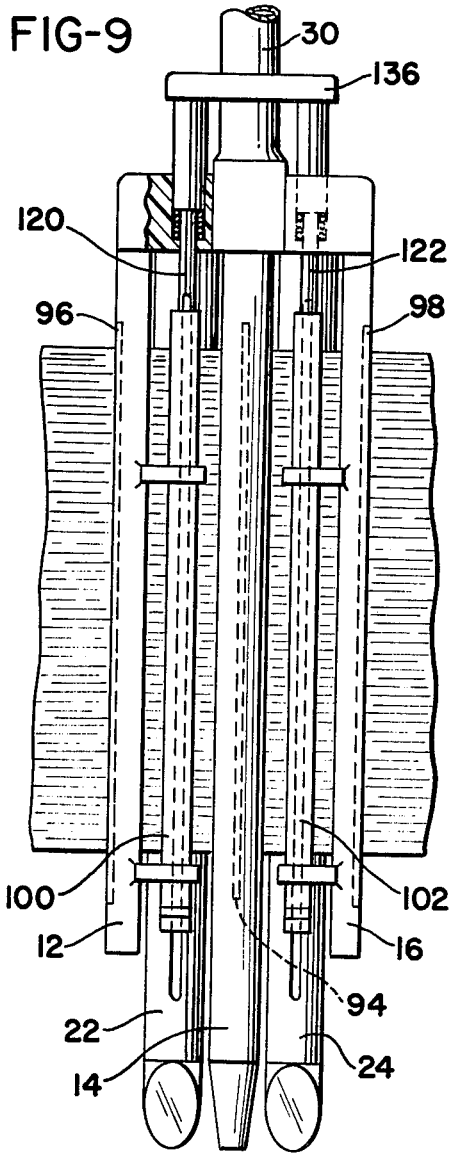
FIG. 9 is a top plan view of the embodiment of FIG. 1 with the elongated waving members in the intermeshed position with the hair positioned therein.
Figure 10:
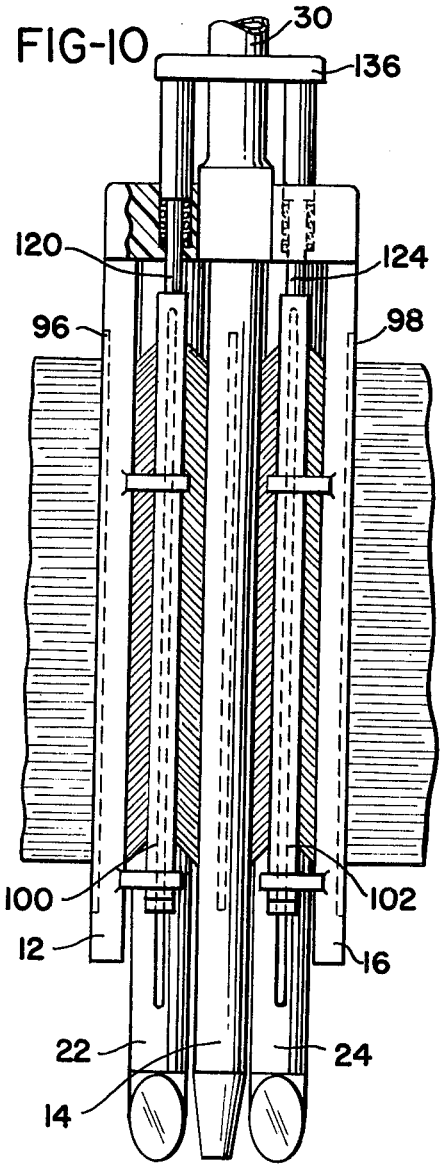
FIG. 10 is a top plan view similar to FIG. 9 with the wave guide comb-like members moved away from the handle portion after engagement with the hair so that the portions of the hair which are engaged by the wave guides are moved laterally relative to the remaining portions of hair.

Prior to rotation of the second group of waving members 20 into rotation with the first group 10, the operator also pushes forward on the crossbar 136 as shown in FIG. 9. Thus, when the two groups of waving members are rotated into the intermeshed position illustrated in FIGS. 8 and 9, the comb-like wave guides 100 and 102 will be in their forward position. After the waving members have been rotated into their position of intermeshing engagement shown in FIG. 9, the operator releases pressure on the crossbar 136 and the biasing springs 128 and 130 force the comb-like wave guide members 100 and 102 to their rearward position, thus causing portions of the hair engaged by the teeth thereof to move rearwardly to cause a lateral shift in that portion of the hair relative to the adjacent portions which are captive by the comb-like members 94, 97, and 98 to produce a lateral wave in the hair in addition to the wave formed by the position of the hair about the various wave guide members as shown in FIG. 8. The device is then left in this position during the setting operation which is accomplished by turning the switch 141 on to cause heating in the heating coils 146, 148 and 150 and if desired, emission of steam through the plurality of holes 80, 82 and 84, if water or other steam setting liquid has been placed in the reservoir, as explained above.

If the operator desires to utilize the present invention for curling hair rather than waving it, the following procedure is followed to separate the various members for that purpose. As illustrated in FIG. 5, the entire first group of waving members 12, 14 and 16 is first separated from the second group 20 by lifting on the support member 40 so as to release the ball-detent members engaging their respective sockets in the sides of lever 70. This then separates the wave guide members 12, 14 and 16 from the wave guide members 22 and 24. Then, the operator slides wave guide member 14 rearwardly relative to wave guide members 12 and 16 which causes the L-shaped bracket 38 to spring upwardly releasing it from the recesses 44 in support member 40. This then presents the wave guide member 14 which is connected to the handle portion 30 and can be separately used for curling the hair by wrapping the hair thereabouts through the teeth of wave guide member 96 which assists in holding the hair in proper position for curling. The device is then operated in the same manner as described above for placing a permanent wave in the hair by operating switch 141 to produce heating in the coil 148 and steam as well, if this is desired.

Figures 11, 12:
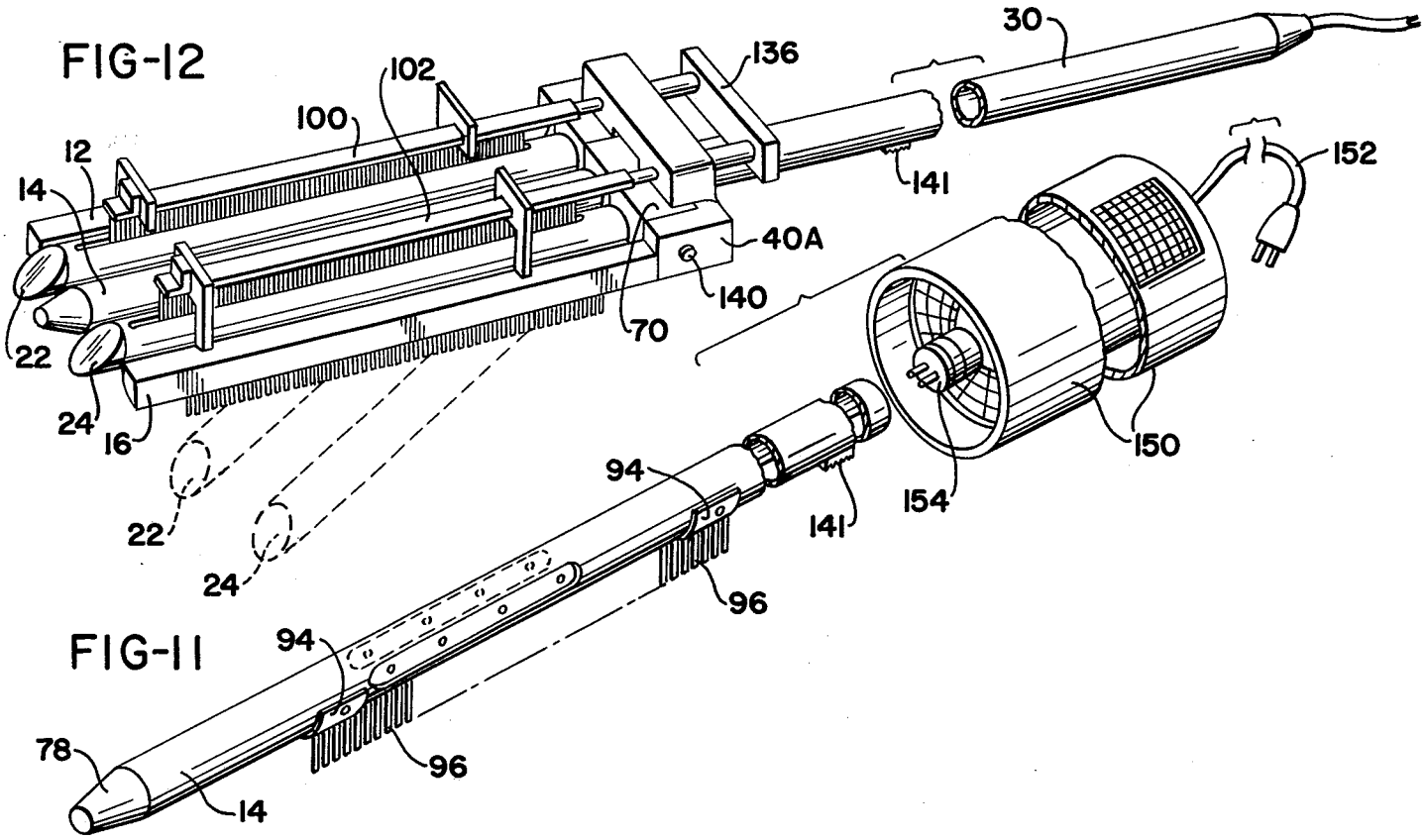
FIG. 11 illustrates a single waving member which has been separated from the embodiment of FIG. 1 for hair curling with a blower attached to the handle portion.
FIG. 12 is a second alternative embodiment in which the two groups of waving members are fixed to the handle and not separable to provide an independent curling device.

Although in its preferred form the device is intended to be separable to provide both hair curling and waving capabilities, it is contemplated that such a device would be desirable without the ability to release one of the waving members for the curling operation. In view of this, a further embodiment is illustrated in FIG. 12 in which the two groups of waving members 10 and 20 are not separable, but are otherwise operable in the manner described above for utilizing the device for waving hair only. In this embodiment, the various electrical connections designed to be removably interconnected are not included and instead, a single pin 140 extends through corresponding holes in support member 40A as well as through lever 70 which supports the second group of wave guide members 22 and 24. A simple electrical connection is made between the various heating coils of the wave guide members and will not be discussed in detail herein.

A further alternative embodiment is illustrated in FIG. 11 wherein the waving member 14 which is separable from the other waving members is provided with a blower 150 connected to the rear portion of handle 30 by removal of removable connector 36. The blower 150 is provided with a rear electrical connection 152 which provides power to both the blower and the heating coil of the waving member 14 through connectors 154 which mates with the female connectors 138 and 140 in the rear portion of handle 30. The blower can then be utilized to assist in drying the hair curled about the waving member 14 in addition to the operation to the heating coil in the above referred to manner.

Although the forgoing illustrates the preferred embodiments of the present invention, other variations are possible. All such variations as would be obvious to one skilled in this art are intended to be included within the scope of the invention as defined by the following claims.

What is claimed is:

1. A hair waving device, comprising:

a handle;

first and second groups of elongated hair waving members mounted on said handle for intermeshing engagement, said first group being rotatable relative to said second group about end portions of both groups adjacent said handle, between a position in which said members of said first and second groups are disposed in a non-intermeshed position sufficiently separated for inserting a plurality of strands of hair and a position wherein said first and second groups are disposed in an intermeshed position wherein said strands of hair are alternately curved together in opposite directions about adjacent ones of said members; and at least one elongated wave guide mounted to said handle for relative rotation with one of said groups of members and for sliding movement longitudinally thereof, said wave guide having means for engaging said hair for causing lateral displacement of a portion thereof longitudinally of said waving members a sufficient distance to impart a wave to the hair.

2. A hair waving device as defined in claim 1 wherein said members of each group are fixedly interconnected in spaced parallel relation, with members of said groups being spaced sufficiently apart that all of said members of both groups are disposed in spaced parallel relation when in said intermeshed position.

3. A hair waving device as defined in claim 1 wherein one of said groups of members is detachably secured to said handle as a unit.

4. A hair waving device as defined in claim 3 wherein one of said members of said detachable group is further separable from the rest for use as a hair curling device.

5. A hair waving device as defined in claim 1, including:

heating means in at least one of said members for permanently setting hair wrapped therearound.

6. A hair waving device as defined in claim 1 wherein said at least one wave guide is in the form of a comb having a plurality of teeth in a row extending parallel to the longitudinal extent of said waving members.

7. A hair waving device as defined in claim 6 wherein said first group includes three of said waving members fixedly secured to said handle in spaced parallel relation and said second group includes two of said waving members rotatably secured to said handle in spaced parallel relation for intermeshing movement so as to be disposed alternately between said three members of said first group when rotated into said intermeshing position.

8. A hair waving device as defined in claim 7 wherein there are five wave guides one each associated with and extending adjacent to each said waving member, at least two of said wave guides being longitudinally movable relative to their associated waving member for causing movement of a portion of said hair passing through said movable wave guides.

9. A hair waving device as defined in claim 8 wherein two of said first group of members are removable from said handle and the remaining member is usable independently thereof and is secured to said handle.

10. A hair waving device as defined in claim 9 wherein said handle has electrical connection means and each said member has heating means for heating hair and which are connected to said electrical connection means.

11. A hair waving device as defined in claim 10 wherein at least said two removable waving members of said first group and said two members of said second group are removably connected to said electrical connection means.

12. A hair waving device as defined in claim 11 including blower means securable to said handle and operably connectable to said electrical connection means for supplying power to at least one of said waving members of said first group of members and said blower means with all of said other waving members disconnected therefrom for use independently as a curling device.

13. A hair waving device, comprising:

a handle;

a first group of hair waving members including:

a first generally cylindrical hair waving member, a first pair of elongated hair waving members disposed in spaced relation on opposite sides of and parallel to said first waving member with at least their adjacent sides being arcuate, all of said waving members being rigidly secured to said handle;

a second pair of generally cylindrical hair waving members disposed in spaced parallel relation on opposite sides of said first waving member between said first pair of waving members;

a combined lever and support member pivotally connected to said handle and supporting said pair of waving members at one end of each for simultaneous pivotal movement toward and away from said first waving member and said first pair of waving members;

a comb-like elongated wave guide secured to said first waving member longitudinally thereof and depending downwardly therefrom;

a pair of comb-like elongated wave guides disposed in spaced parallel relation in registry with and above said second pair of waving members and supported by said handle for linear reciprocating motion axially of said second pair of waving members, for displacing hair axially of said second pair of waving members and maintaining it in fixed position during setting of the hair so as to form a wave therein; and means in at least said first hair waving member for applying heat to the hair for setting it.

* * * * *